United States Patent [19]

Schillinger et al.

[11] 4,326,633

[45] Apr. 27, 1982

[54] SEALED BEAM HEADLIGHT CARTON

[75] Inventors: Joseph F. Schillinger, Morrison, Ill.; William B. Bicksler, Dubuque, Iowa; Herbert L. Lambert, Manchester, Mo.

[73] Assignee: Champion International Corporation, Stamford, Conn.

[21] Appl. No.: 197,578

[22] Filed: Oct. 16, 1980

[51] Int. Cl.[3] ..... B65D 85/42

[52] U.S. Cl. ..... 206/418; 206/453; 206/586

[58] Field of Search ..... 206/418, 453, 586, 521, 206/583, 448, 454, 455, 456

[56] References Cited

U.S. PATENT DOCUMENTS

| | | | |
|---|---|---|---|
| 2,256,995 | 3/1941 | Andres | 206/586 |
| 2,877,942 | 3/1959 | Van Antwerpen | 206/586 |
| 4,019,637 | 4/1977 | Kurtz | 206/418 |
| 4,200,192 | 4/1980 | Klomp | 206/418 |

*Primary Examiner*—Joseph Man-Fu Moy

*Attorney, Agent, or Firm*—Evelyn M. Sommer

[57] ABSTRACT

A container preferably supporting a sealed beam headlight in which a pair of opposite flaps at each end are each provided with a short flap extending partially across each of the original flaps and secured thereto. The short adhesive flaps in turn have a longer flap attached thereto wherein the sum of the lengths of the longer flap and the short adhesive flap is greater than that of the first flap so that when the first flap is folded into closed position, the additional flap connected to the adhesive flap necessarily moves down into a diagonal relationship between the closing flap and the inside of the side wall. This structure is repeated on both sides at both ends. The diagonal flaps cushion the headlight. Each of the diagonal flaps in turn has a further flap which in the closed condition of the container extends along the inside of the side wall. The diagonal flaps are shorter transversely than the first flap thereby creating a further flap section extending the remainder of the distance across the first flap and folded over in surface-to-surface relation therewith, and embossed, so that a shock absorbing end is provided for the portion of the sealed beam headlight which extends thereinto.

6 Claims, 5 Drawing Figures

SEALED BEAM HEADLIGHT CARTON

The present invention relates to containers and more paticularly to a container for supporting a sealed beam headlight in such a manner that it will withstand the processes of distribution and handling prior to opening of the container and installation of the headlight.

The sealed beam headlight is provided with prongs that are utilized to electrically and mechanically connect the headlight into the automobile front end structure. These prongs, however, even though they are intended to provide some mechanical as well as electrical support may nevertheless, because they project from the structure, be readily damaged during shipping.

Various means have been provided to support the headlight against physical damage and to protect the prongs. The present invention is directed to a container that will so position the headlight in a carton that the headlight itself and the prongs or other mechanical and electrical connecting elements of the headlight will be fully protected.

Essentially the invention is thus directed to a preglued collapsible container which may be erected to receive the sealed beam headlight, the structure being so arranged that, regardless of the end of the headlight which is inserted first, the headlight itself will be supported resiliently by end flap members which cushion the headlight and rigidify its position within the container so that the headlight itself and the electromechanical elements at the ends opposite the face of the headlight will be completely protected against shocks.

Since the face and bulb of the headlight are welded together, this happens to be a critically weak area of the headlight. The diagonal interior flap extensions which thus form cushioning elements for one end of the headlight also provide a hold-down for the other end of the headlight to provide a cushioned support.

Embossed plugs in flap sections adjacent the diagonal flaps further cushion portions of the headlight. These embossed plugs may be filled themselves with a softer cushioning material which will provide some resilience in addition to the resilience of the embossing. These shock absorbing elements will somewhat increase the thickness of the collapsed container when it is shipped, but will nevertheless have the concomitant advantage of providing full protection for the headlight.

Essentially the present invention comprises the utilization of a pair of flaps at each end so arranged that extensions thereof are glued into surface-to-surface with the said flaps, said extensions having further extensions so arranged that they will extend diagonally from the folded over flap to the side wall of the container when the ends are closed thereby providing a cushioning structure at each end. Similar flaps are connected at each end to the same pair of walls of the container and the container is additionally provided with a cover which may be a pair of cover flaps at each end of the adjacent pair of side walls which do not carry the embossed flaps.

The foregoing and various objects of the present invention will become apparent in the following description and drawing in which.

Figure 1:
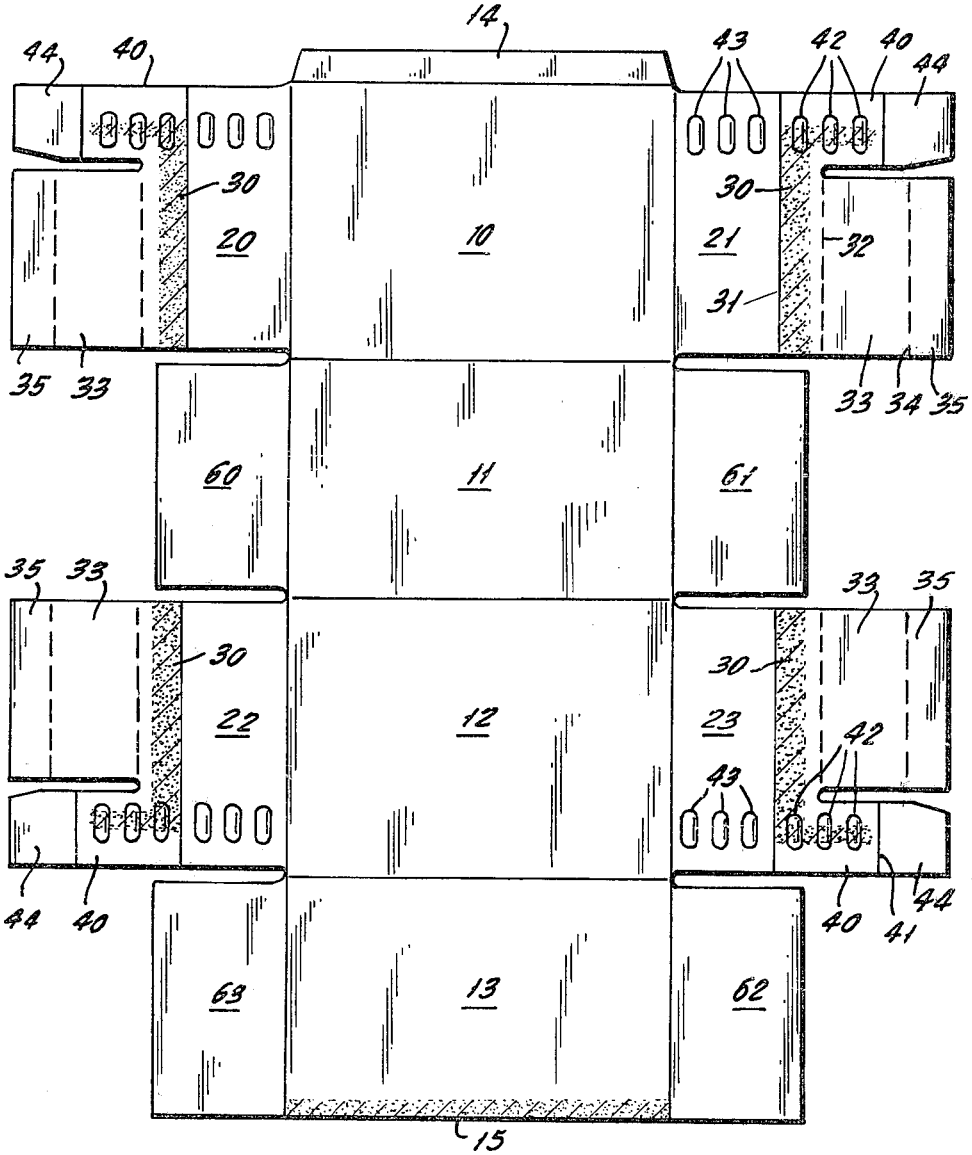
FIG. 1 is a plan view of a blank from which the structure of the present invention is made.
Figure 2:
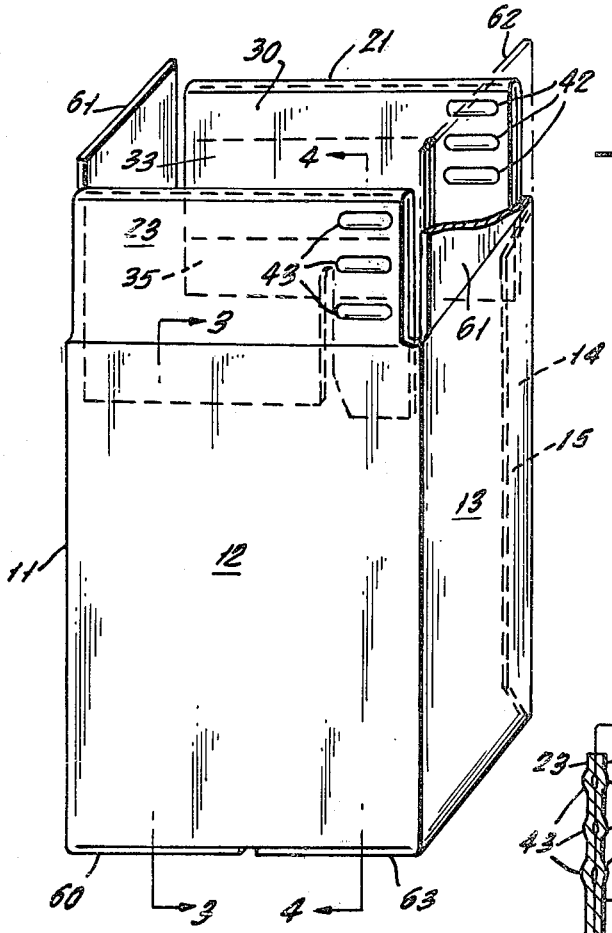
FIG. 2 is a view partly in phantom showing the blank of FIG. 2 folded up to an open ended container adapted to receive one end of the sealed beam bulb.
Figure 4:
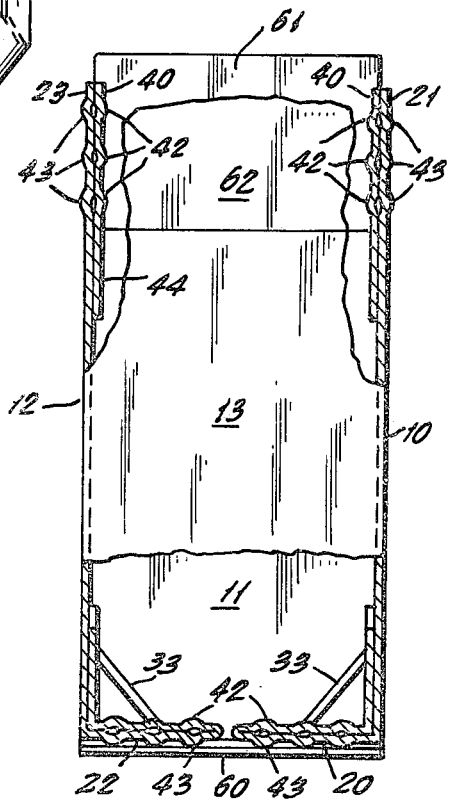
FIG. 4 is a cross-sectional view taken on line 4—4 of FIG. 2.

As seen in FIGS. 1 and 2 the container comprises a pair of opposite side walls 10 and 12 connected by an associated pair of opposite side walls 11 and 13. The container may then be connected up in tubular form by utilization of the glue flap 14 which may be secured at the area 15 of wall 13, preferably on the inside section of area 15 of wall 13.

Each of the walls 10 and 12 is provided with a pair of flaps 20, 21 at each end (for wall 10) and 22, 23 (for wall 12). Each of the flaps 20, 21, 22 and 23 has a panel 30 extending therefrom which may be folded back on the fold line 31 and glued into face-to-face relation with its associated panel 20 or 21, 22 or 23.

A fold line 32 is provided at the outer end of the glued panel 30 to which is connected the additional diagonal panel 33 which will in the final structure serve as a cushioning support for a portion of the sealed beam headlight.

Each panel 33 is connected by the fold line 34 to the additional support panel 35 which when the final panel is folded in will serve as a support for the panel 33. This can be seen particularly in FIGS. 3 and 5 wherein the closing panel 21 is shown connected by the fold line 31 to the glued panel 30 which in turn is connected by the fold line 32 to the cushioning panel 33 which in turn is connected by the fold line 34 to the support panel 35. Thus, with each of the end panels so arranged that section 30 thereof is adhesively secured to section 21 thereof, then when the panels are folded to the closed position, owing to the dimensional relationship, panel 35 will necessarily slide along the inside of the associated wall 10 or 12 as the case may be to position the diagonal cushioning support panel 33 for the headlight 50 which is encased in the container.

Figure 5:
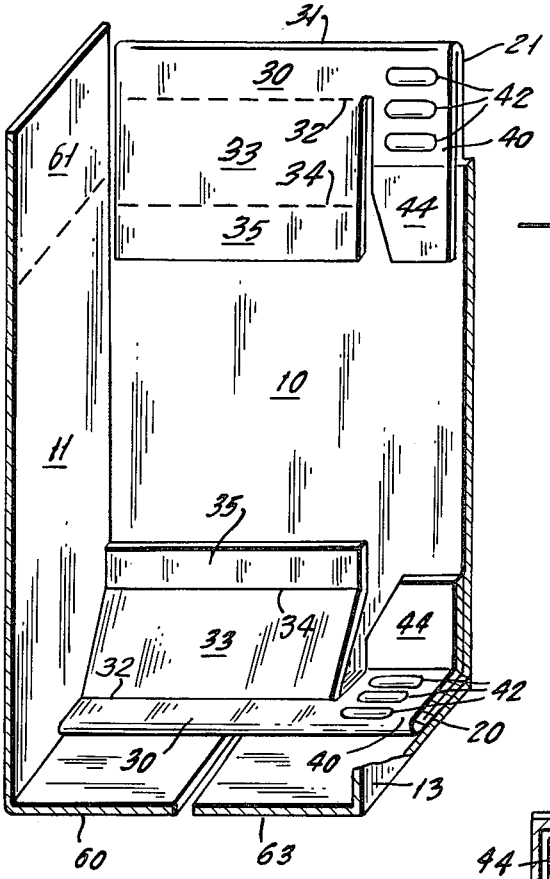
FIG. 5 is a partial perspective view, partly broken away of a lower corner of the container.
Figure 3:
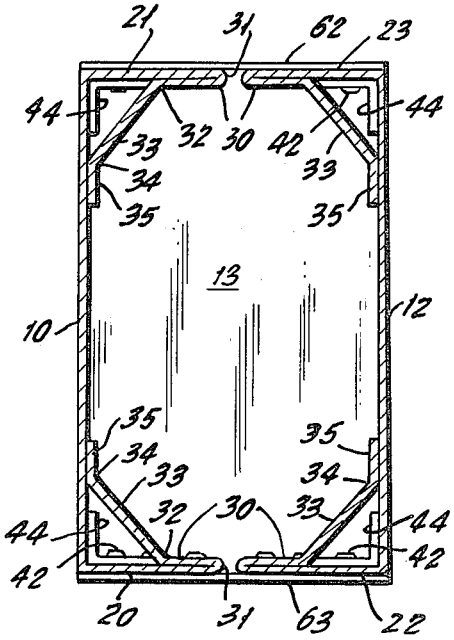
FIG. 3 is a cross-sectional view taken on line 3—3 of FIG. 2 showing the sealed beam headlight in place in the container.

In FIGS. 3 and 5 one end of the structure is shown broken away so that the manner in which the sealed beam headlight is supported for cushioning is demonstrated. Since the opposite end of the container is made in exactly the same way having the same kind of panel arrangement, then it does not matter which end of the sealed beam headlight is inserted first. However, it is necessary to hold down the sealed beam headlight and that is the reason that both ends of the container are made in such a manner that the end opposite to the one shown broken away in FIGS. 3 and 5 acts as a hold-down for the end of the sealed beam headlight.

It will also be noted that each of the panels 20, 21, 22 and 23 is provided, not only with the panel 30 which is to be adhesively secured thereto in surface-to-surface relation, but also with panel 40 which is connected by the fold line 41 to the extension 44. The panel 40 is in surface-to-surface secured coterminous arrangement with the panel 30 so that the panel 40 simply extends along the inside of the closure panel. However, the panel 40 is provided with a plurality of embossments 42, 42 not only in the panel 40 but matching also embossments 43, 43 in the underlying section of the panel 20, 21, 22, 23, as the case may be, with which they are connected. Hence, the panel 40 provides a cushioned support area for any extensions of the headlight or any of the mechanical elements of the headlight which may extend thereto. Although the mechanical elements of the headlight are positioned by the positioning of the sealed beam headlight as a whole, any side movement of the extension of the headlight is resisted by the side of the diagonal panel 33 and in the event the container should be even slightly crushed, the embossments 42–43 act to relieve the mechanical strain which might be imposed.

When the container is erected the flaps 20, 21, 22, 23 are folded inwardly, this automatically sets up the shock absorbing slanted support members 33 as well as arranging the embossments 42, 43 so that they will serve to support any object which bears against them; the sides of the shock absorbing panels 33 serving as a side support for the container structure.

Since the container is similar at each end, the headlight may be inserted from either end and the closure of the flaps 20, 21, 22, 23 will provide all of the additional support. Thereafter the final closing flaps 60, 61, 62, 63 extending respectively from walls 11 and 13 may then be folded over and sealed in any suitable manner to complete the closure.

In this way the sealed beam headlight is supported on a cushioned structure formed by the diagonal support members 33 on each side at one end. The sealed beam headlight structure is held down by the diagonal support members 33 at the other end. Any extensions of the sealed beam headlight are positioned by the side of the support member 33 and any possible shock impinging against the end of the structure or the prongs of the sealed beam headlight will be in part absorbed by the cushioning members 42, 43. These cushioning members 42, 43 are, in effect, bubble type members created by embossing the material of the carton at the particular points where these members are to be formed.

If it is desired to have further protection, the opposing embossed areas may be filled and sealed with a hot melt type of adhesive, thereby creating a resilient bumper effect. This would provide additional protective qualities to the carton.

In the foregoing, the present invention has been described solely in connection with preferred illustrative embodiments thereof; since many variations and modifications of the present invention will now be obvious to those skilled in the art; it is preferred that the scope of this invention be determined not by the specific disclosures herein contained, but only by the appended claims.

What is claimed is:

1. A shock absorbing carton for receiving and supporting a fragile structure; said shock absorbing carton being of tubular construction have a pair of opposite side walls and a pair of additional walls interconnecting the side walls; each of the pair of opposite side walls having a first flap extending from each end thereof; each flap having an additional panel foldably connected thereto and being folded into surface-to-surface relation with said first mentioned flap and secured thereto; said additional flap being narrower than said first-mentioned flap; a third flap secured to said additional flap along a fold line and foldable with respect thereto; said third flap and said additional flap together having a length greater than the length of said first-mentioned flap; said third flap, when said first-mentioned flap is folded into closing position with respect to the container, sliding down the associated side wall to a position in which it extends diagonally from said first-mentioned flap to said side wall; and a fourth flap foldably connected to said third mentioned flap; said fourth flap extending in surface-to-surface relation with the inside of the associated side wall when said first flap is closed to cover said end of said container; said first flaps on each of said first-mentioned walls being closed to form a cushion structure for receiving a fragile object with the third mentioned flaps extending diagonally between the first-mentioned flap and the inside of the associated side wall to provide a cushion for said object at each end; and additional flaps on the other walls for completing the closure of said container.

2. The container of claim 1, wherein said third mentioned flap is notched at a point spaced from the side thereof; said notch extending to said second flap; said notch defining a fifth support flap foldably secured to said first flap; said fifth flap extending in surface-to-surface relation with said first mentioned flap when said second flap is folded in; said third mentioned flap extending more than half the transverse width of the flap structure and said fifth flap, separated by a notch from said third mentioned flap, extending in surface-to-surface relation with said first-mentioned flap for the remainder of the transverse width of the structure; and a sixth flap connected to said last-mentioned narrower fifth flap extending in surface-to-surface relation with the same inner wall of the container as the fourth mentioned flap when the container is closed.

3. The container of claim 2, wherein the section of the first-mentioned flap and the fifth flap which are in surface-to-surface relation to each other being embossed to provide a cushioning structure for an object at that side of the container at which such flaps are located.

4. The container of claim 3, wherein said narrower embossed fifth flap is adhesively secured to its associated section of the first-mentioned flap with matching embossed sections in said fifth flap and first flap.

5. The container of claim 4, wherein the means for adhesive securement is a hot melt adhesive which provides additional cushioning at the embossed sections.

6. The container of claim 5, wherein the object to be received and supported by the container comprises a sealed beam automobile headlight, wherein the third mentioned flaps at each end and on each side support and hold down the headlight while the extensions of said headlight structure are supported laterally by the side of the third mentioned flap which extends partly across the first-mentioned flap and wherein other elements of the said headlight may be supported by and cushioned by said emboassed sections.

* * * * *